US011260663B2

(12) United States Patent
Yasumoto

(10) Patent No.: US 11,260,663 B2
(45) Date of Patent: Mar. 1, 2022

(54) PRINTER

(71) Applicant: FUNAI ELECTRIC CO., LTD., Osaka (JP)

(72) Inventor: Atsushi Yasumoto, Itami (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 0 days.

(21) Appl. No.: 17/049,769

(22) PCT Filed: May 29, 2019

(86) PCT No.: PCT/JP2019/021249
§ 371 (c)(1),
(2) Date: Oct. 22, 2020

(87) PCT Pub. No.: WO2020/110352
PCT Pub. Date: Jun. 4, 2020

(65) Prior Publication Data

US 2021/0235841 A1 Aug. 5, 2021

Related U.S. Application Data

(60) Provisional application No. 62/773,520, filed on Nov. 30, 2018.

(51) Int. Cl.
*B41J 2/165* (2006.01)
*A45D 29/00* (2006.01)

(52) U.S. Cl.
CPC ..... *B41J 2/16505* (2013.01); *B41J 2/165* (2013.01); *B41J 2/16508* (2013.01); *B41J 2/16511* (2013.01); *B41J 2/16544* (2013.01); *A45D 29/00* (2013.01); *A45D 2029/005* (2013.01)

(58) Field of Classification Search
CPC ..... B41J 2/16505; B41J 2/16508; B41J 2/16511; B41J 2/165; B41J 2/16544; A45D 29/00; A45D 2029/005; A45D 29/18
See application file for complete search history.

(56) References Cited

U.S. PATENT DOCUMENTS 7,708,374 B2 * 5/2010 Ha ..... B41J 2/16511 347/29
8,752,956 B2 * 6/2014 Bitoh ..... B41J 3/36 347/108
2013/0019799 A1 1/2013 Bitoh

FOREIGN PATENT DOCUMENTS

JP 2002-187287 7/2002
JP 2006-130666 5/2006
JP 2011-214792 10/2011
(Continued)

OTHER PUBLICATIONS

International Search Report (ISR) dated Aug. 20, 2019 in International (PCT) Application No. PCT/JP2019/021249.

*Primary Examiner* — Geoffrey S Mruk
(74) *Attorney, Agent, or Firm* — Wenderoth, Lind & Ponack, L.L.P.

(57) ABSTRACT

A printer includes a head having a nozzle face which ejects ink toward an object, a driving mechanism which moves the head in a first direction and a second direction approximately orthogonal to the first direction, a nozzle cap movable between a first position where the nozzle face is capped and a second position where the nozzle face is uncapped, and a lock mechanism which regulates movement of the head in the first direction and the second direction in the state where the nozzle cap is in the first position.

4 Claims, 14 Drawing Sheets

(56) References Cited

FOREIGN PATENT DOCUMENTS

| | | |
|---|---|---|
| JP | 2012-250396 | 12/2012 |
| JP | 2013-59579 | 4/2013 |
| JP | 2014-40020 | 3/2014 |
| JP | 2016-169999 | 9/2016 |
| JP | 2018-153940 | 10/2018 |

* cited by examiner

PRINTER

TECHNICAL FIELD

The present disclosure relates to a printer for printing on objects.

BACKGROUND ART

Printers for printing manicure colors or motifs on fingernails of hands of users using an ink jet method are known (see PTL 1, for example). The printer of this type includes a head having a nozzle face which ejects ink to a fingernail, and a driving mechanism which moves the head in a first direction and a second direction approximately orthogonal to the first direction.

Such a printer is configured to cap the nozzle face with a nozzle cap to prevent clogging caused by drying of the nozzle face when the head is in a standby position.

CITATION LIST

Patent Literature

[PTL 1] Japanese Unexamined Patent Application Publication No. 2013-59579

SUMMARY OF INVENTION

Technical Problem

The printer described above is carried to a variety of places in a house for use, for example. However, vibration when the printer is being carried may unexpectedly move the head in the first direction and the second direction with respect to the nozzle cap, so that the nozzle cap may be removed from the nozzle face.

The present disclosure has been made to solve such a problem above, and an object of the present disclosure is to provide a printer which ensures capping of a nozzle face of a head with a nozzle cap.

Solution to Problem

To solve the above object, the printer according to one aspect of the present disclosure is a printer for printing on an object, the printer including: a head including a nozzle face which ejects ink toward the object; a driving mechanism which moves the head in a first direction and a second direction approximately orthogonal to the first direction; a nozzle cap movable between a first position where the nozzle face is capped and a second position where the nozzle face is uncapped; and a lock mechanism which regulates movement of the head in the first direction and the second direction in a state where the nozzle cap is in the first position.

According to this aspect, the lock mechanism regulates the movement of the head in the first direction and the second direction in the state where the nozzle cap is in the first position. Thus, for example, even if any vibration is applied to the printer when the printer is being carried, the head can be prevented from unexpected movement in the first direction and the second direction with respect to the nozzle cap. As a result, removal of the nozzle cap from the nozzle face of the head can be prevented, ensuring capping of the nozzle face of the head with the nozzle cap.

For example, in the printer according to one aspect of the present disclosure, the driving mechanism may be configured to include a driving source; a worm gear rotatable by the driving source; a worm wheel engaged with the worm gear; and a drive conversion mechanism which converts rotation of the worm wheel to movement of the head in the first direction. The lock mechanism may regulate the movement of the head in the first direction by utilizing a self-locking characteristic of the worm gear in the state where the nozzle cap is in the first position.

According to this aspect, because the lock mechanism regulates the movement of the head in the first direction by utilizing a self-locking characteristic of the worm gear in the state where the nozzle cap is in the first position, the driving mechanism can also serve as the lock mechanism. As a result, the number of parts of the printer can be reduced, resulting in a smaller printer.

For example, in the printer according to one aspect of the present disclosure, the printer may be configured to further include an interlocking mechanism which moves the nozzle cap from the second position to the first position in conjunction with movement of the head from one side to an other side in the first direction.

According to this aspect, the nozzle cap can be moved from the second position to the first position by the interlocking mechanism in conjunction with the movement of the head.

For example, in the printer according to one aspect of the present disclosure, the interlocking mechanism may be configured to include a first engaging part disposed in the head; a cap holder which holds the nozzle cap; and a second engaging part which is disposed in the cap holder and is engageable with the first engaging part. The first engaging part may be configured to engage with the second engaging part when the head moves from the one side to the other side in the first direction, causing the nozzle cap to move from the second position to the first position in conjunction with the movement of the head, and the lock mechanism may configured to regulate movement of the head in the second direction by utilizing engagement between the first engaging part and the second engaging part in the state where the nozzle cap is in the first position.

According to this aspect, because the lock mechanism regulates the movement of the head in the second direction by utilizing the engagement between the first engaging part and the second engaging part in the state where the nozzle cap is in the first position, the interlocking mechanism can also serve as the lock mechanism. As a result, the number of parts of the printer can be reduced, resulting in a smaller printer.

For example, in the printer according to one aspect of the present disclosure, the printer may be configured to further include a holding mechanism which holds the nozzle cap in a third position between the first position and the second position; and a wiper held by the cap holder. The head may move in the second direction with respect to the nozzle cap in the state where the nozzle cap is held in the third position, causing the wiper to wipe the nozzle face.

According to this aspect, because the holding mechanism holds the nozzle cap in the third position, the nozzle face of the head can be held in a position allowing wiping by the wiper.

For example, in the printer according to one aspect of the present disclosure, the holding mechanism may be configured to include an urging member which urges the nozzle cap from the first position toward the second position; a lever member rotatably held by the cap holder; and a nail member which is engageable with the lever member. When the head moves from the other side to the one side in the first direction in the state where the nozzle cap is in the first position, the nozzle cap may move from the first position toward the third position by an urging force from the urging member, the lever member swings to engage with the nail member, causing the nozzle cap to be held in the third position. When the head further moves from the other side to the one side in the first direction in the state where the nozzle cap is held in the third position, the lever member may swing to disengage from the nail member, allowing the urging force from the urging member to move the nozzle cap from the third position to the second position.

According to this aspect, the holding mechanism can be implemented with a relatively simple configuration.

Advantageous Effects of Invention

The printer according to one aspect of the present disclosure can ensure capping of the nozzle face of the head with the nozzle cap.

DESCRIPTION OF EMBODIMENTS

Embodiments according to the present disclosure will now be described in detail with reference to the drawings. The embodiments described below all illustrate comprehensive or specific examples. Numeric values, shapes, materials, components, arrangements and positions of the components, and connection forms thereof shown in the following embodiments are exemplary, and should not be construed as limitations to the present disclosure. Moreover, among the components of the embodiments below, the components not described in an independent claim will be described as arbitrary components.

Embodiment 1

[1-1. Configuration of Printer]

Figure 1:
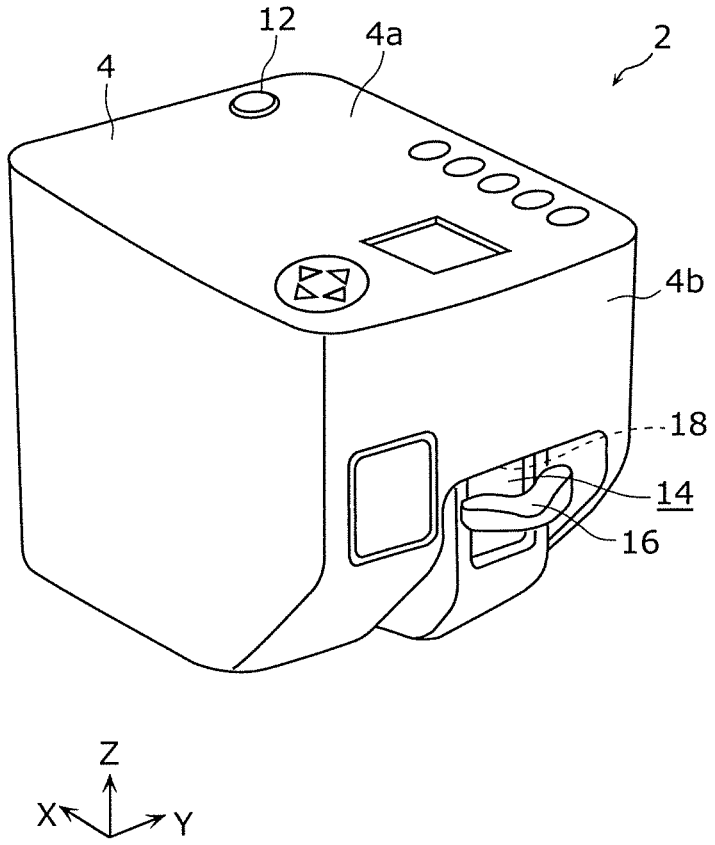
FIG. 1 is a perspective view illustrating the appearance of the printer according to Embodiment 1.
Figure 2:
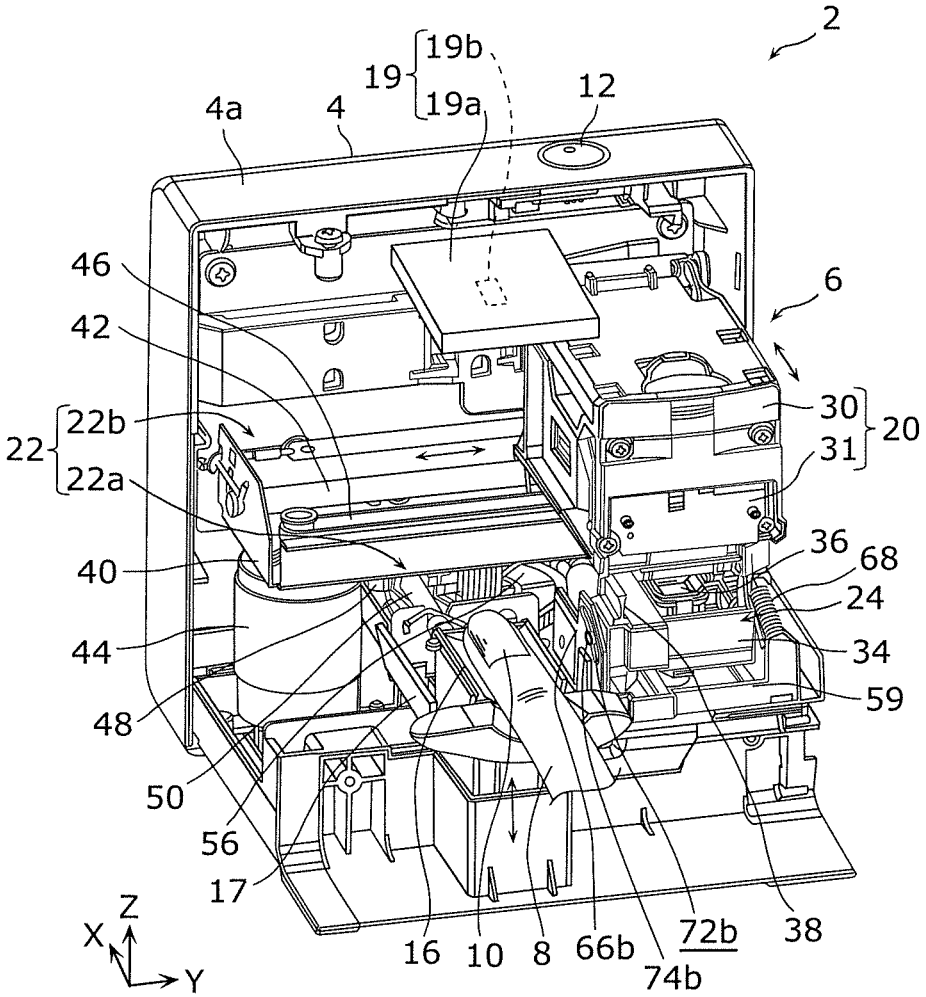
FIG. 2 is a perspective view illustrating a printing unit of the printer according to Embodiment 1.

First, the configuration of printer 2 according to Embodiment 1 will be described with reference to FIGS. 1 and 2. FIG. 1 is a perspective view illustrating the appearance of printer 2 according to Embodiment 1. FIG. 2 is a perspective view illustrating printing unit 6 of printer 2 according to Embodiment 1. For convenience of the description, part of housing 4 is not illustrated in FIG. 2.

As illustrated in FIGS. 1 and 2, printer 2 includes housing 4, and printing unit 6 disposed inside housing 4. In the present embodiment, printer 2 is a so-called nail printer for printing a manicure color or motif on nail 10 of finger 8 of a hand of a user (one example of an object).

Printer 2 can wirelessly communicate with an external terminal (not illustrated) such as a smartphone or a tablet terminal. The user can operate printer 2 using application software installed in the external terminal as an interface.

As illustrated in FIG. 1, housing 4 is made of a resin, and has a boxed shape. Top surface 4*a* of housing 4 includes power supply switch 12 for turning on/off the power supply of printer 2.

As illustrated in FIG. 1, front surface 4*b* of housing 4 includes opening 14 into which finger 8 of the user is inserted. As illustrated in FIGS. 1 and 2, finger holder 16 for placing finger 8 of the user is disposed in a lower portion of opening 14 (on the minus side of the Z-axis). As illustrated in FIG. 1, press cover 18 for pressing finger 8 of the user from above is disposed above opening 14 (on the plus side of the Z-axis). Finger holder 16 can move vertically to press cover 18 (in the Z-axis direction), and is urged with a spring (not illustrated) in a direction approaching to press cover 18.

Figure 3:
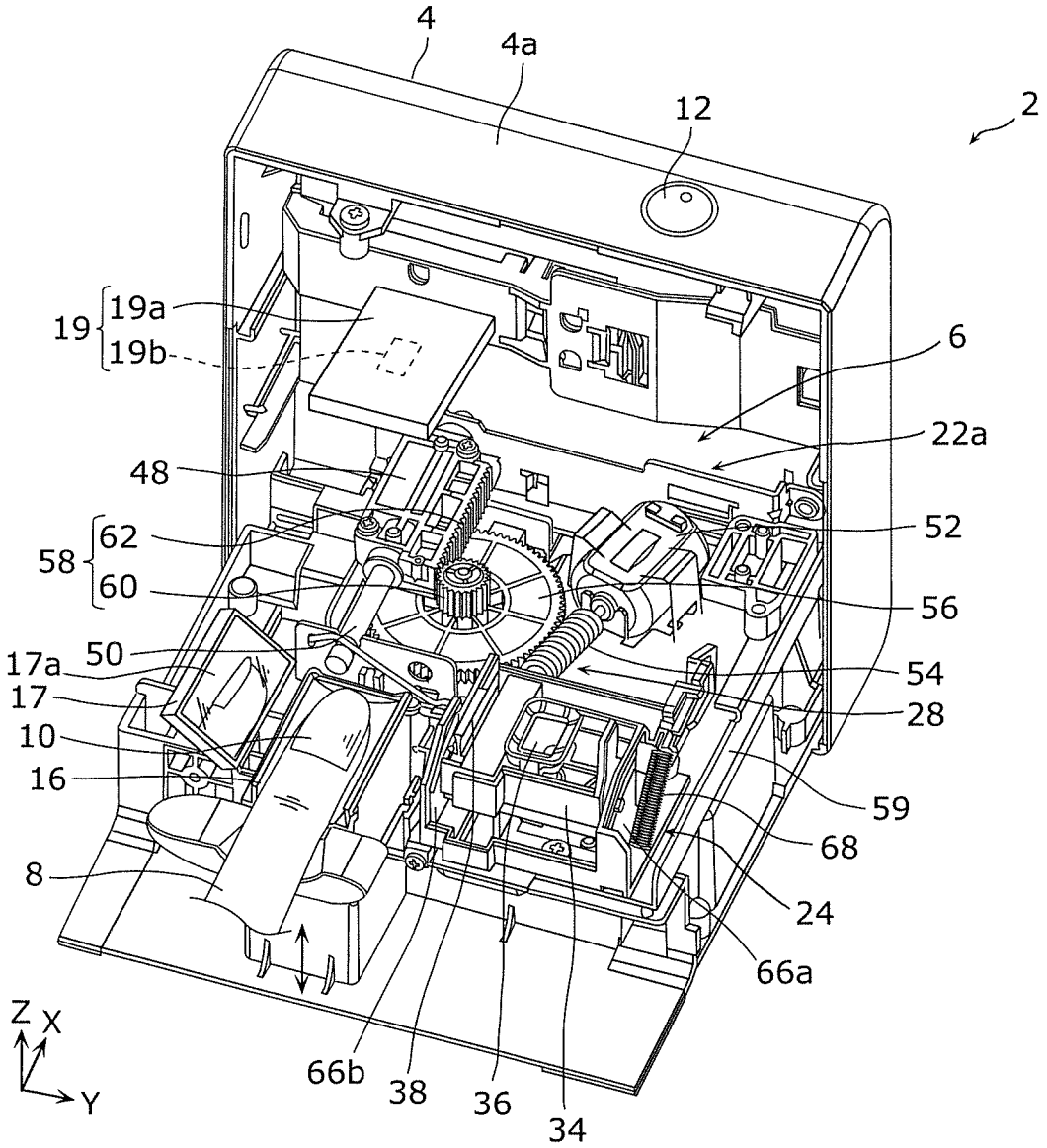
FIG. 3 is a perspective view illustrating the printing unit of the printer according to Embodiment 1 where the head and the Y-axis driving mechanism are omitted.

As illustrated in FIGS. 2 and 3 described later, mirror 17 is disposed on a lateral side of finger holder 16. Mirror 17 is a side view mirror having mirror surface 17*a* for reflecting a side of the surface of nail 10 of finger 8 placed on finger holder 16. Mirror 17 is disposed inclined to the vertical direction (Z-axis direction) such that mirror surface 17*a* faces obliquely upward.

As illustrated in FIG. 2, the user inserts finger 8 into opening 14 of housing 4 such that finger 8 extends straight and nail 10 of finger 8 faces upward (see FIG. 1), and places the palm side of finger 8 on finger holder 16. Thereby, a portion of finger 8 including nail 10 (for example, a portion from the tip of finger 8 to near the first joint thereof) is disposed inside housing 4. At this time, finger holder 16 is urged in a direction approaching to press cover 18. As a result, a portion of finger 8 near the first joint is held from above and below the portion by finger holder 16 and press cover 18.

Nail 10 of finger 8 disposed inside housing 4 is captured by camera unit 19 disposed above finger holder 16 to face finger holder 16. Camera unit 19 includes wiring substrate 19*a* disposed above finger holder 16 to face finger holder 16, and image capturer 19*b* mounted on a bottom surface of wiring substrate 19*a*. Wiring substrate 19*a* is held by an inner cover (not illustrated) disposed inside housing 4, for example. Image capturer 19*b* directly captures an image of the top of the surface of nail 10 of finger 8 placed on finger holder 16, and captures an image of the side of the surface of nail 10 of finger 8 reflected on mirror surface 17*a* of mirror 17. The image data of nail 10 captured by image capturer 19*b* is wirelessly transmitted from printer 2 to the external terminal, and is displayed on a display screen of the external terminal. The user views the image data of nail 10 presented on the display screen of the external terminal to check the position of nail 10 on finger holder 16.

Printing unit 6 is a unit for performing manicure printing on nail 10 of finger 8 disposed inside housing 4. The printing method for printing unit 6 is an ink jet method of printing by spraying a mist of ink onto nail 10 of finger 8.

As illustrated in FIG. 2, printing unit 6 includes head 20, driving mechanism 22, head maintaining mechanism 24, interlocking mechanism 26 (see FIG. 4 described later), and lock mechanism 28 (see FIGS. 3 and 4 described later).

Head 20 includes head holder 30 and ink head 31 mounted on head holder 30. Ink head 31 contains several color inks inside thereof. The bottom surface of head 20 includes nozzle face 32 (see FIGS. 4 and 6 described later) which ejects the ink downwardly toward nail 10 of finger 8.

Driving mechanism 22 is a mechanism for two-dimensionally moving head 20 in a first direction (X-axis direction) and a second direction (Y-axis direction) approximately orthogonal to the first direction. A specific configuration of driving mechanism 22 will be described later.

Head maintaining mechanism 24 is a mechanism for maintaining nozzle face 32 of head 20. Head maintaining mechanism 24 is disposed on one side (on the plus side of the Y-axis) with respect to the central portion of the moving region of head 20 in the second direction, and is disposed below nozzle face 32 of head 20. Head maintaining mechanism 24 includes cap holder 34, nozzle cap 36, and wiper 38.

Cap holder 34 can move in a direction approaching to nozzle face 32 of head 20 and in a direction away from nozzle face 32. Nozzle cap 36 is a cap for capping (sealing) nozzle face 32 of head 20 in a standby position (described later), and is held by cap holder 34. Wiper 38 is a wiper blade for wiping (cleaning) nozzle face 32 of head 20, and is held by cap holder 34. Wiper 38 is made of a rubber or elastomer resin having flexibility, for example.

Interlocking mechanism 26 is a mechanism for moving nozzle cap 36 held by cap holder 34 in the direction approaching to nozzle face 32 of head 20 in conjunction with the movement of head 20 from one side to the other side of the first direction (from the minus side to the plus side of the X-axis). A specific configuration of interlocking mechanism 26 will be described later.

Lock mechanism 28 is a mechanism for regulating the movement of head 20 in the first direction and the second direction in the state where nozzle face 32 of head 20 is capped with nozzle cap 36. A specific configuration of lock mechanism 28 will be described later.

[1-2. Configuration of Driving Mechanism]

Next, the configuration of driving mechanism 22 will be described with reference to FIGS. 2 and 3. FIG. 3 is a perspective view illustrating printing unit 6 of printer 2 according to Embodiment 1 where head 20 and Y-axis driving mechanism 22*b* are omitted.

Driving mechanism 22 includes X-axis driving mechanism 22*a* for moving head 20 in the first direction, and Y-axis driving mechanism 22*b* for moving head 20 in the second direction.

As illustrated in FIG. 2, Y-axis driving mechanism 22*b* includes movable table 40, Y-axis guide shaft 42, Y-axis motor 44, and timing belt 46.

Y-axis guide shaft 42 is held by movable table 40 disposed inside housing 4, and extends in the second direction in an elongated form. Head 20 is movably held by Y-axis guide shaft 42. Y-axis motor 44 is configured with a servomotor, for example, and is held by the bottom surface of movable table 40.

The driving force of Y-axis motor 44 is transmitted through timing belt 46 to head 20. As a result, head 20 reciprocally moves-on movable table 40 along Y-axis guide shaft 42 in the second direction.

As illustrated in FIG. 3, X-axis driving mechanism 22*a* includes movable table 40 (see FIG. 2), bearing member 48, X-axis guide shaft 50, X-axis motor 52 (one example of a driving source), worm gear 54, worm wheel 56, and drive conversion mechanism 58.

X-axis guide shaft 50 is held by support plate 59 disposed inside housing 4, and extends in the first direction in an elongated form. Bearing member 48 fixed to the bottom surface of movable table 40 is movably held by X-axis guide shaft 50. In other words, movable table 40 is movably held by X-axis guide shaft 50 through bearing member 48. X-axis motor 52 is configured with a servomotor, for example, and is held by support plate 59. Worm gear 54 is rotatably held by the driving shaft of X-axis motor 52. Worm wheel 56 is rotatably held by support plate 59, and is engaged with worm gear 54.

Drive conversion mechanism 58 is a mechanism for converting the rotation of worm wheel 56 to linear movement of head 20 in the first direction. Drive conversion mechanism 58 includes pinion gear 60 disposed in worm wheel 56, and rack gear 62 disposed in bearing member 48. Pinion gear 60 and rack gear 62 are engaged with each other.

The driving force of X-axis motor 52 is transmitted through worm gear 54, worm wheel 56, pinion gear 60, and rack gear 62 to movable table 40. As a result, head 20 reciprocally moves together with movable table 40 along X-axis guide shaft 50 in the first direction.

Nail 10 of finger 8 is printed by ejecting the ink from nozzle face 32 of head 20 toward nail 10 of finger 8 in the state where head 20 is moving from the other side to one side of the first direction (from the plus side to the minus side of the X-axis) while reciprocally moving in the second direction.

After the printing is completed, head 20 moves from the current location to the other side to one side of the first direction (from the plus side to the minus side of the X-axis), moves from the other side to one side of the second direction (from the minus side to the plus side of Y-axis), and once stops at the position (hereinafter, referred to as "relay position") illustrated in FIG. 2 and FIG. 4 (described later). Subsequently, head 20 further moves from one side to the other side of the first direction (from the minus side to the plus side of the X-axis), and stops at the position (hereinafter, referred to as "standby position") illustrated in FIG. 7 (described later).

[1-3. Configuration of Interlocking Mechanism]

Next, the configuration of interlocking mechanism 26 will be described with reference to FIG. 2 and FIGS. 4 to 9. FIG. 4 is a side view illustrating printing unit 6 of printer 2 according to Embodiment 1 where nozzle cap 36 is in the second position. FIG. 5 is a perspective view illustrating printing unit 6 of printer 2 according to Embodiment 1 where nozzle cap 36 is in the second position. FIG. 6 is a partially enlarged diagram illustrating printing unit 6 of printer 2 according to Embodiment 1 where nozzle cap 36 is in the second position.

Figure 6:
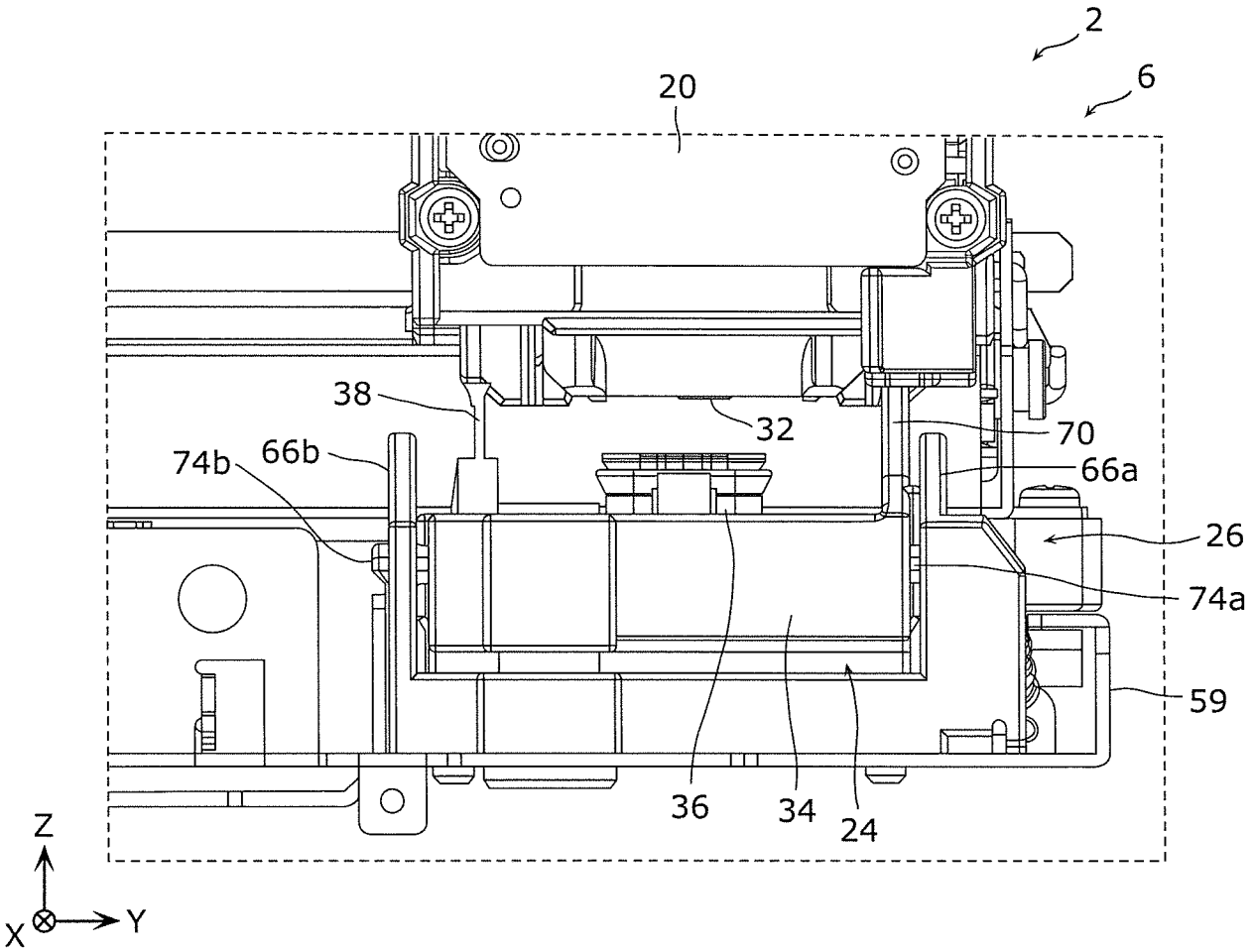
FIG. 6 is a partially enlarged diagram illustrating the printing unit of the printer according to Embodiment 1 where the nozzle cap is in the second position.
Figure 7:
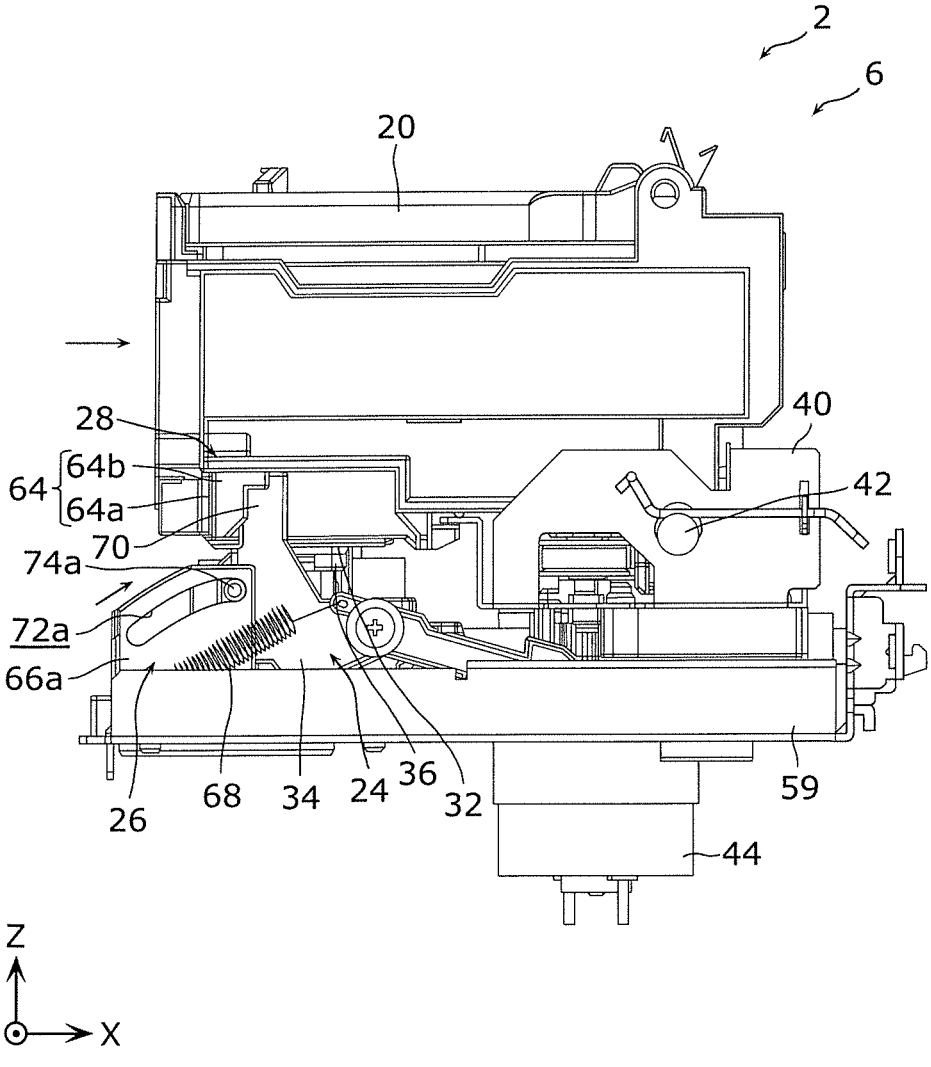
FIG. 7 is a side view illustrating the printing unit of the printer according to Embodiment 1 where the nozzle cap is in a first position.
Figure 8:
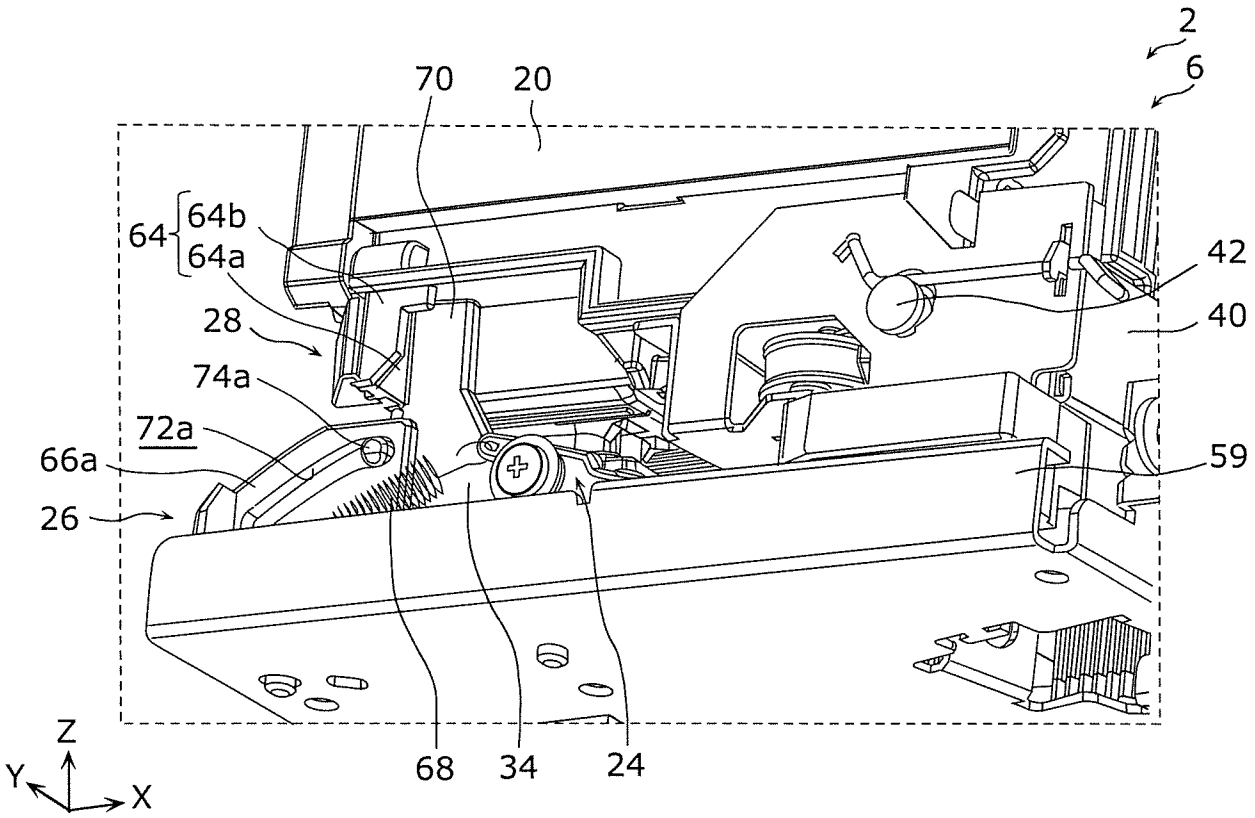
FIG. 8 is a perspective view illustrating the printing unit of the printer according to Embodiment 1 where the nozzle cap is in the first position.
Figure 9:
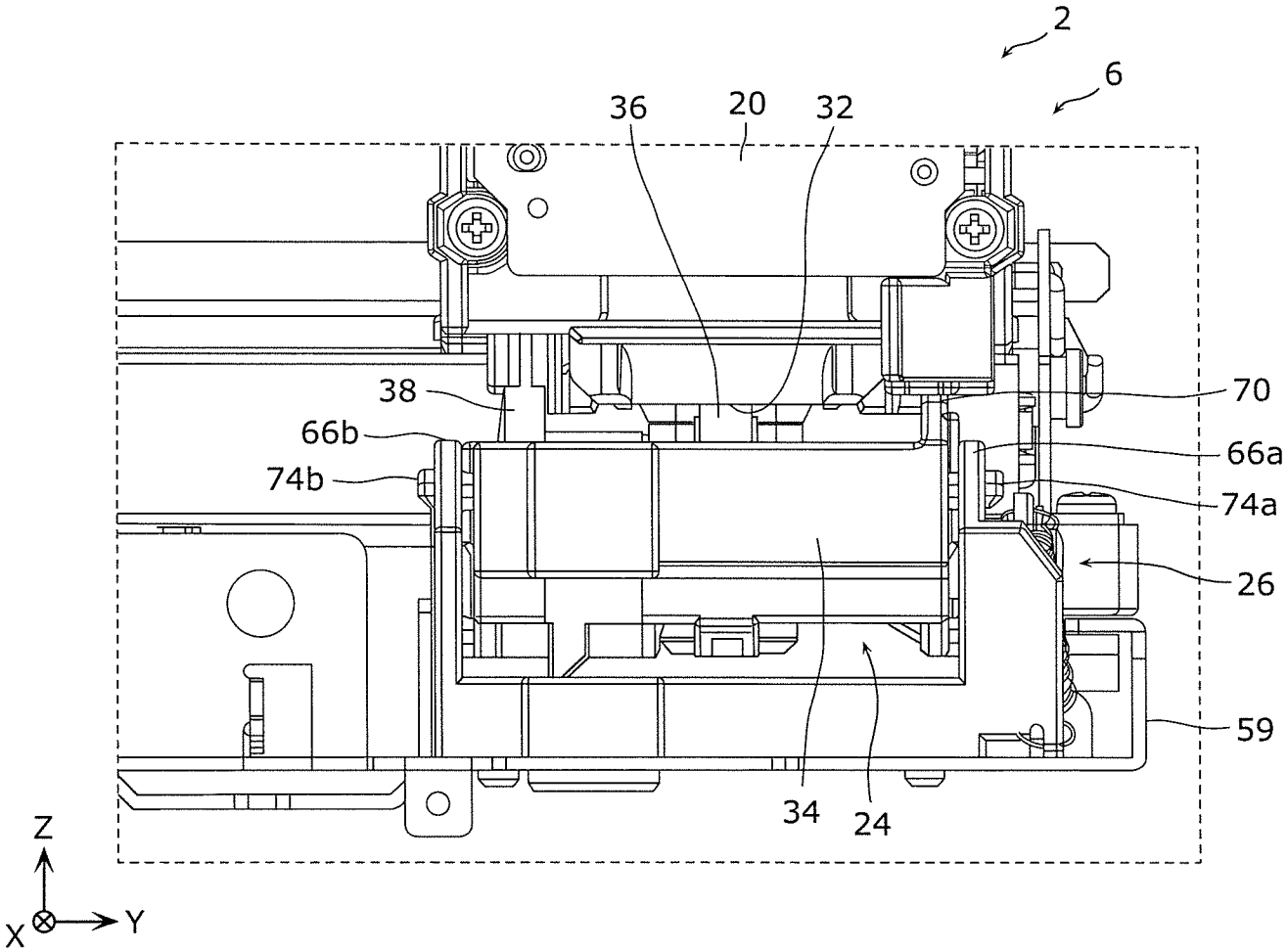
FIG. 9 is a partially enlarged diagram illustrating the printing unit of the printer according to Embodiment 1 where the nozzle cap is in the first position.

FIG. 7 is a side view illustrating printing unit 6 of printer 2 according to Embodiment 1 where nozzle cap 36 is in the first position. FIG. 8 is a perspective view illustrating printing unit 6 of printer 2 according to Embodiment 1 where nozzle cap 36 is in the first position. FIG. 9 is a partially enlarged diagram illustrating printing unit 6 of printer 2 according to Embodiment 1 where nozzle cap 36 is in the first position. For convenience of the description, housing 4 and the like are not illustrated in FIGS. 4 to 9.

Figure 4:
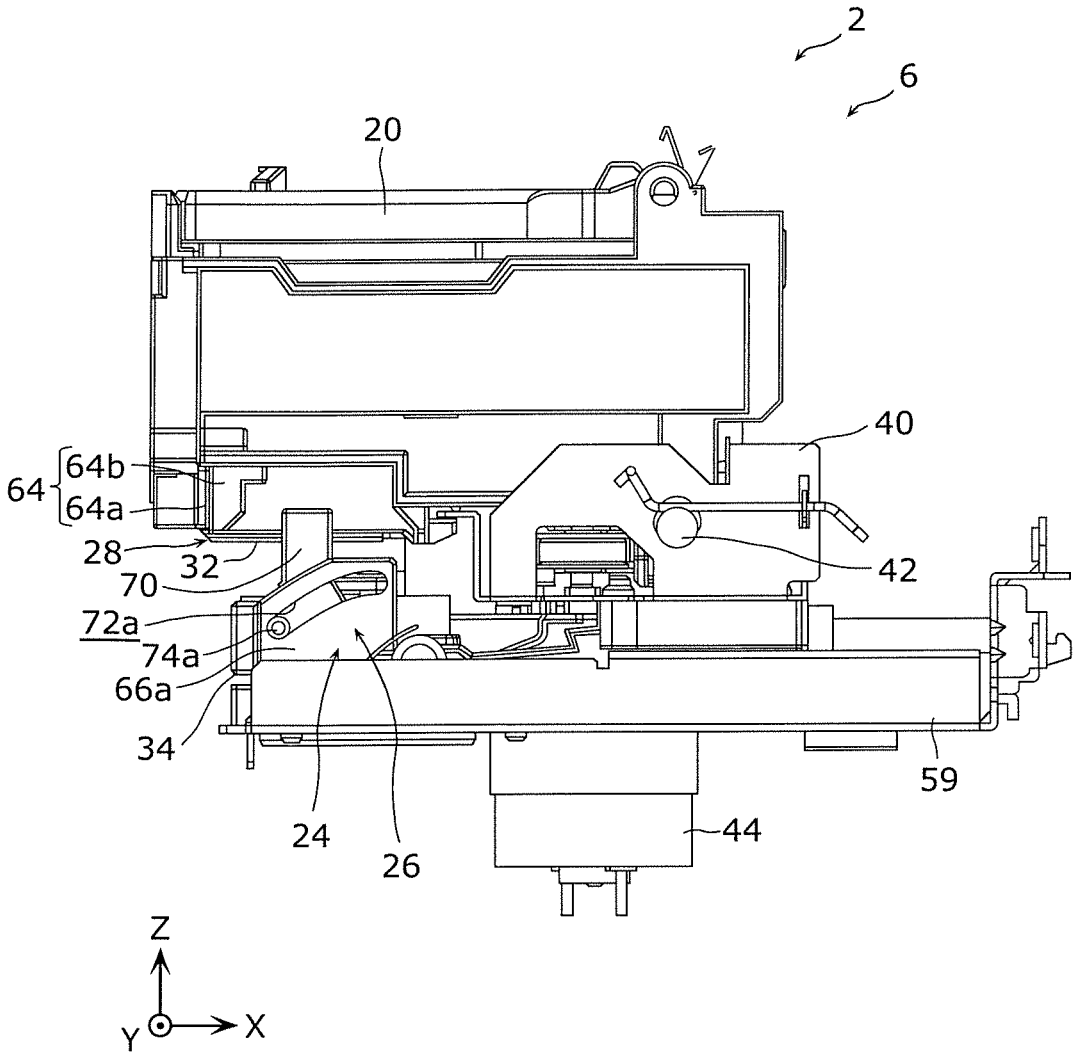
FIG. 4 is a side view illustrating the printing unit of the printer according to Embodiment 1 where the nozzle cap is in a second position.
Figure 5:
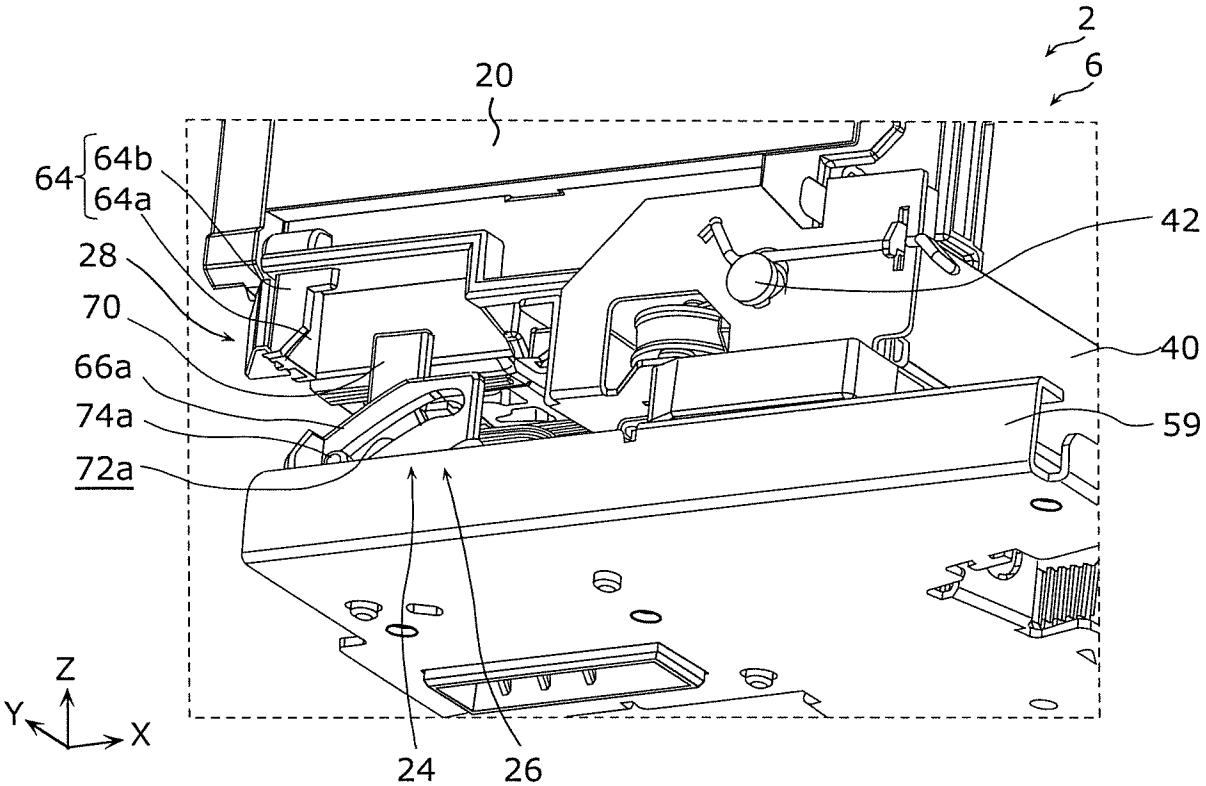
FIG. 5 is a perspective view illustrating the printing unit of the printer according to Embodiment 1 where the nozzle cap is in the second position.

As illustrated in FIGS. 4 to 6, interlocking mechanism 26 includes first engaging part 64, a pair of guide plates 66*a* and 66*b*, cap holder 34, urging member 68 (see FIG. 7), and second engaging part 70.

As illustrated in FIG. 4, first engaging part 64 is disposed at a lower end of the lateral surface of head 20. As illustrated in FIG. 5, the shape thereof in an X-Y cross-section of first engaging part 64 is approximately L-shaped. In other words, first engaging part 64 includes first wall 64*a* extending approximately vertical from the lateral surface of head 20, and second wall 64*b* further extending approximately vertical from an end of first wall 64*a*. In other words, second wall 64*b* is disposed facing the lateral surface of head 20.

As illustrated in FIG. 2 and FIGS. 4 to 6, a pair of guide plates 66*a* and 66*b* are held by support plate 59, and are disposed at an interval in the second direction. The pair of guide plates 66*a* and 66*b* include guide holes 72*a* and 72*b*, respectively. Guide holes 72*a* and 72*b* extend obliquely upward from one side to the other side of the first direction (from the minus side to the plus side of the X-axis).

As illustrated in FIG. 2 and FIGS. 4 to 6, a pair of lateral surfaces of cap holder 34 facing each other in the second direction include protrusions 74*a* and 74*b*, respectively. Protrusions 74*a* and 74*b* are movably inserted into guide holes 72*a* and 72*b*, respectively. Protrusions 74*a* and 74*b* move along guide holes 72*a* and 72*b*, respectively, and as a result, nozzle cap 36 moves between the first position where nozzle face 32 of head 20 is capped (the position illustrated in FIGS. 7 to 9) and the second position away from nozzle face 32 where nozzle face 32 is uncapped (the position illustrated in FIGS. 4 to 6).

As illustrated in FIGS. 7 and 8, urging member 68 is configured with a coil spring, for example, and urges nozzle cap 36 from the first position toward the second position. One end of urging member 68 is held by one of the lateral surfaces of cap holder 34, and the other end of urging member 68 is held by support plate 59.

As illustrated in FIGS. 4 and 5, second engaging part 70 is formed into a plate shape, and extends from the upper end of one of the lateral surfaces of cap holder 34 toward head 20. When head 20 moves from the relay position to the standby position, second engaging part 70 engages with first engaging part 64.

Next, the operation of interlocking mechanism 26 will be described with reference to FIGS. 4 to 9. As illustrated in FIGS. 4 to 6, in the state where head 20 is in the relay position, nozzle cap 36 is held in the second position by the urging force from urging member 68, and first engaging part 64 is disengaged from second engaging part 70.

Head 20 moves from the relay position toward the standby position (from one side to the other side of the first direction), and reaches a position between the relay position and the standby position (hereinafter, referred to as "intermediate position"). At this timing, second engaging part 70 is engaged with first wall 64*a* of first engaging part 64.

As illustrated in FIGS. 7 to 9, head 20 further moves from the intermediate position toward the standby position in the state where first wall 64*a* of first engaging part 64 is engaged with second engaging part 70. As a result, nozzle cap 36 moves from the second position to the first position in conjunction with the movement of head 20 while nozzle cap 36 is resisting against the urging force from urging member 68. At the timing when head 20 reaches the standby position, nozzle cap 36 reaches the first position to cap nozzle face 32 of head 20.

For example, when head 20 moves from the standby position to the relay position at the start of printing, first wall 64*a* of first engaging part 64 disengages from second engaging part 70. Thereby, nozzle cap 36 moves from the first position to the second position by the urging force from urging member 68.

[1-4. Configuration of Lock Mechanism]

Next, the configuration of lock mechanism 28 will be described.

First, the function of lock mechanism 28 to regulate the movement of head 20 in the first direction will be described with reference to FIG. 3, where nozzle cap 36 is in the first position. In this case, as illustrated in FIG. 3, lock mechanism 28 is implemented with worm gear 54 and worm wheel 56.

Specifically, the lead helix angle of worm gear 54 is set to be less than or equal to the angle of friction. For this reason, in the state where the rotations of worm gear 54 and worm wheel 56 are stopped, the frictional resistance generated on the surfaces of the engaging teeth of worm gear 54 prevents worm gear 54 from being rotated from worm wheel 56 side, that is, a so-called self-locking acts. In other words, in the state where the driving of X-axis motor 52 is stopped, the rotation of worm gear 54 is self-locked even if an external force in the first direction is applied to head 20. Thus, head 20 is held in the standby position.

As described above, by utilizing such a self-locking characteristic of worm gear 54, lock mechanism 28 regulates the movement of head 20 in the first direction in the state where nozzle cap 36 is in the first position.

Next, the function of lock mechanism 28 to regulate the movement of head 20 in the second direction will be described with reference to FIG. 8, where nozzle cap 36 is in the first position. In this case, as illustrated in FIG. 8, lock mechanism 28 is implemented with first engaging part 64 and second engaging part 70.

Specifically, second wall 64*b* of first engaging part 64 is engaged with second engaging part 70 in the state where head 20 is in the standby position. For this reason, head 20 is held in the standby position even if an external force from one side to the other side of the second direction (from the minus side to the plus side of the Y-axis) is applied to head 20.

As described above, by utilizing the engagement between first engaging part 64 and second engaging part 70, lock mechanism 28 regulates the movement of head 20 in the second direction in the state where nozzle cap 36 is in the first position.

[1-5. Effects]

As described above, lock mechanism 28 regulates the movement of head 20 in the first direction and the second direction in the state where nozzle cap 36 is in the first position. Thus, for example, even if any vibration is applied to printer 2 when printer 2 is being carried, head 20 can be prevented from unexpected movement in the first direction and the second direction with respect to nozzle cap 36. As a result, removal of nozzle cap 36 from nozzle face 32 of head 20 can be prevented, further ensuring capping of nozzle face 32 of head 20 with nozzle cap 36.

Embodiment 2

[2-1. Configuration of Printer]

Figure 10:
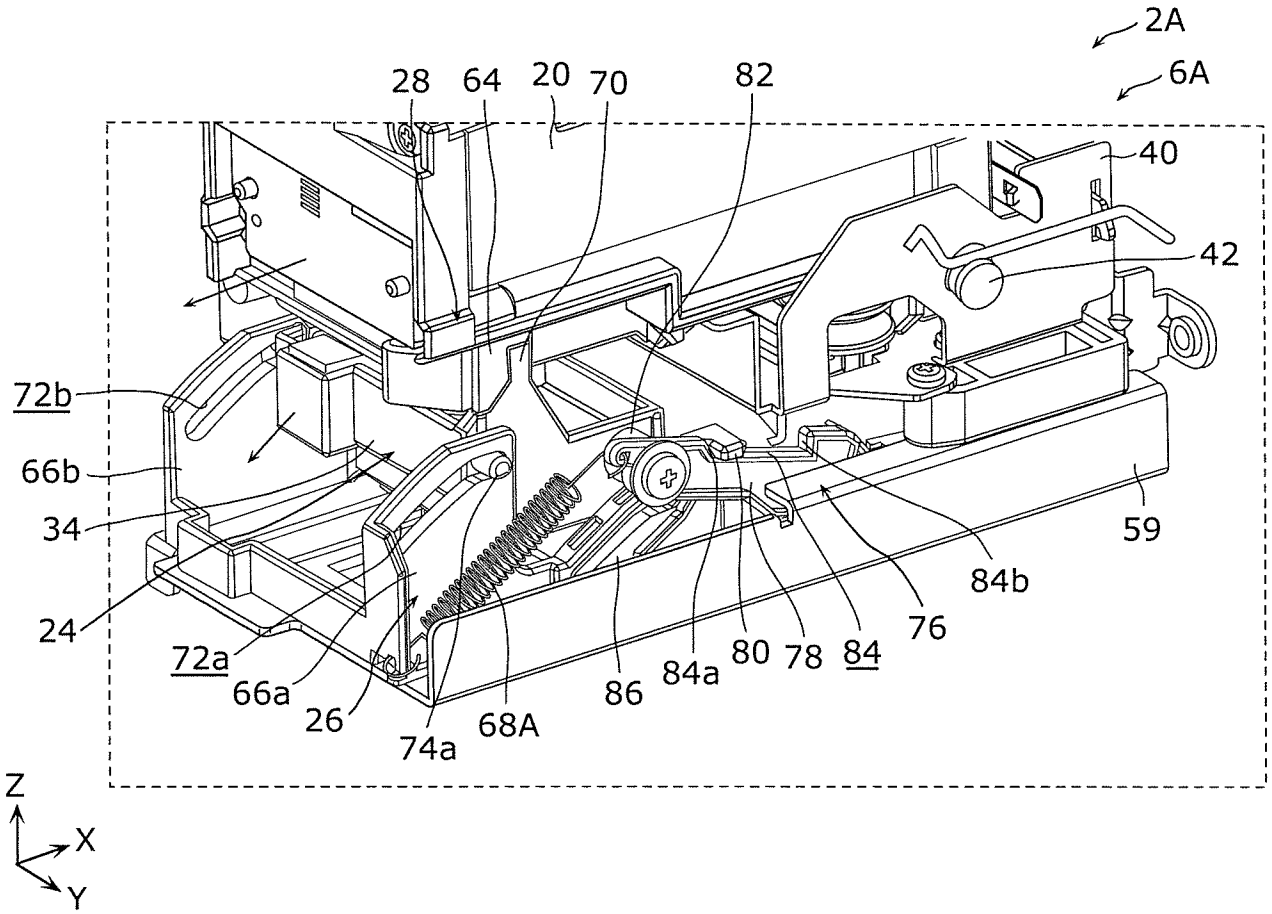
FIG. 10 is a perspective view illustrating a printing unit of the printer according to Embodiment 2 where the nozzle cap is in the first position.
Figure 11:
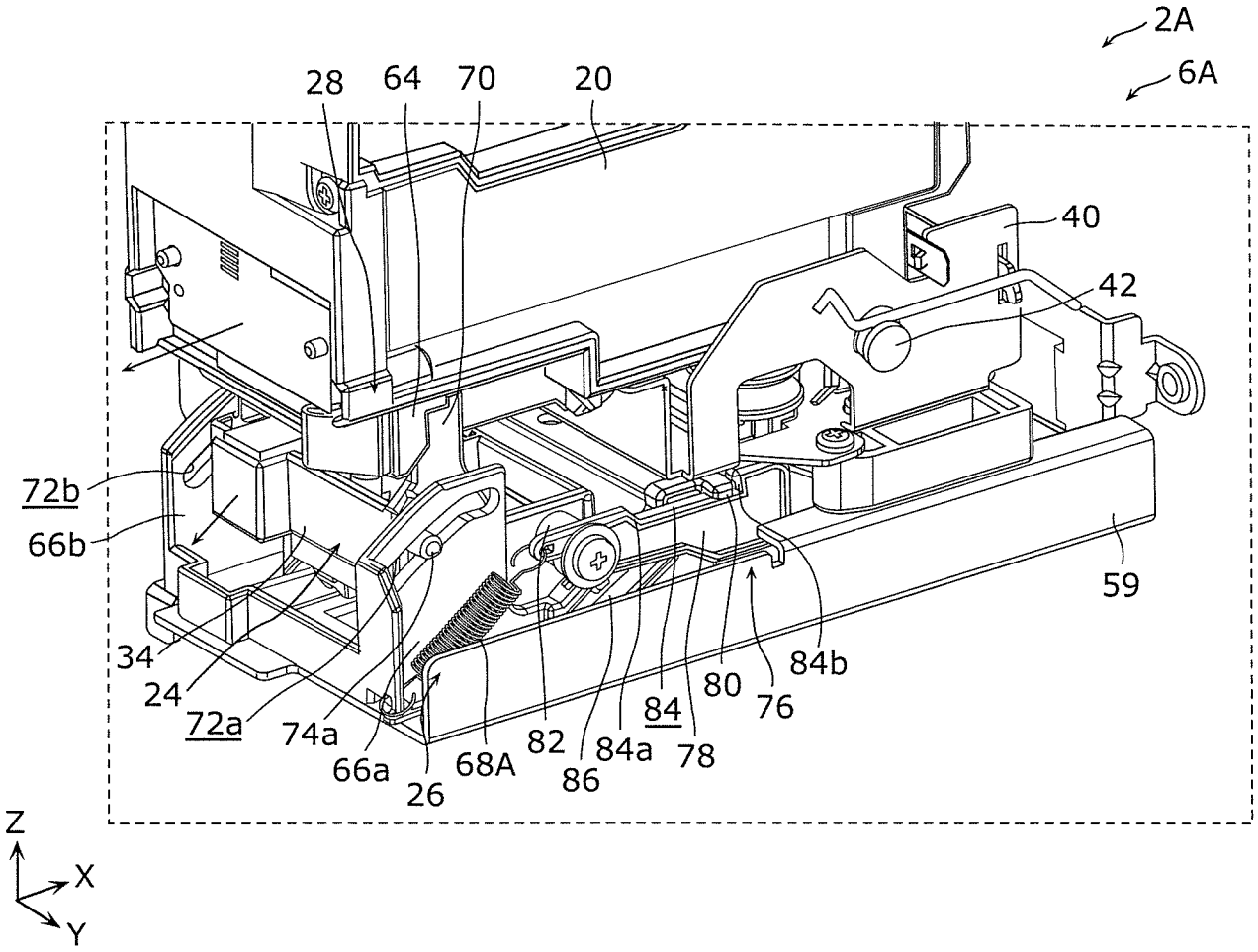
FIG. 11 is a perspective view illustrating the printing unit of the printer according to Embodiment 2 where the nozzle cap is in a third position.
Figure 12:
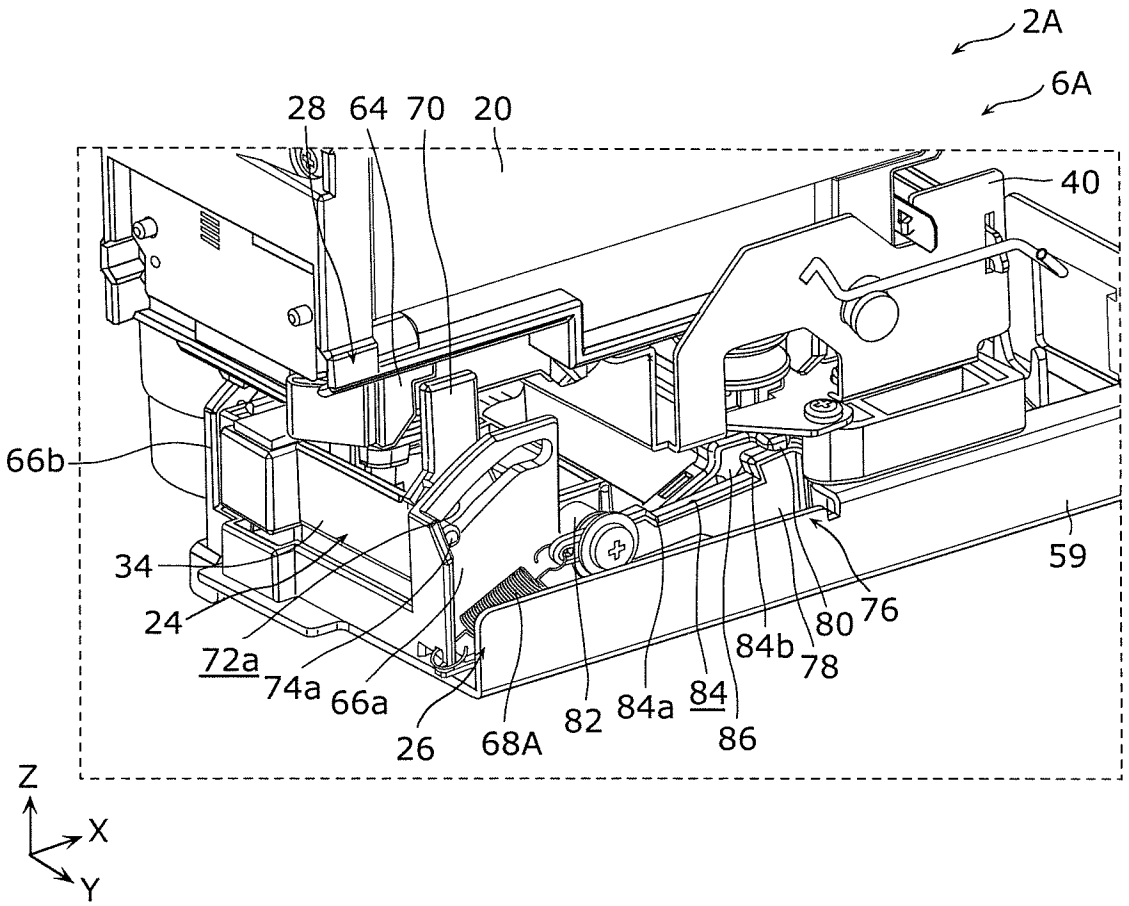
FIG. 12 is a perspective view illustrating the printing unit of the printer according to Embodiment 2 where the nozzle cap is in the second position.

The configuration of printer 2A according to Embodiment 2 will be described with reference to FIGS. 10 to 12. FIG. 10 is a perspective view illustrating printing unit 6A of printer 2A according to Embodiment 2 in the state where nozzle cap 36 is in a first position. FIG. 11 is a perspective view illustrating printing unit 6A of printer 2A according to Embodiment 2 in the state where nozzle cap 36 is in a third position. FIG. 12 is a perspective view illustrating printing unit 6A of printer 2A according to Embodiment 2 in the state where nozzle cap 36 is in a second position. In the present embodiment, the same referential numerals will be given to the same components as those in Embodiment 1, and the descriptions thereof will be omitted.

As illustrated in FIGS. 10 to 12, unlike printer 2 according to Embodiment 1, printer 2A according to the present embodiment includes printing unit 6A including holding mechanism 76. Holding mechanism 76 is a mechanism for holding nozzle cap 36 at a third position (the position illustrated in FIGS. 11, 13, and 14 (described later)) between a first position (the position illustrated in FIG. 10) and a second position (the position illustrated in FIG. 12). Holding mechanism 76 includes lever member 78, urging member 68A, and nail member 80. Nozzle face 32 of head 20 is wiped by wiper 38 in the state where holding mechanism 76 holds nozzle cap 36 in the third position.

Lever member 78 is formed into a shape of an elongated plate. One end of lever member 78 in the longitudinal direction is rotatably held by rotary shaft 82 disposed on one of the lateral surfaces of cap holder 34. Lever member 78 extends from rotary shaft 82 to the other side of the first direction (the plus side of the X-axis). In other words, lever member 78 can swing around rotary shaft 82 vertically (within an X-Z plane). One lateral surface of lever member 78 in the lateral direction (the lateral surface facing head 20) includes cut-off portion 84 extending in the longitudinal direction of lever member 78.

One end of urging member 68A is held by one end of lever member 78, and the other end of urging member 68A is held by support plate 59.

Nail member 80 is disposed at the upper end of support wall 86 erected from the top surface of support plate 59. Nail member 80 is engageable with one end 84*a* (the end close to rotary shaft 82) of cut-off portion 84 of lever member 78 and the other end 84*b* (the end remote from rotary shaft 82) thereof.

[2-2. Operation of Holding Mechanism]

Figure 13:
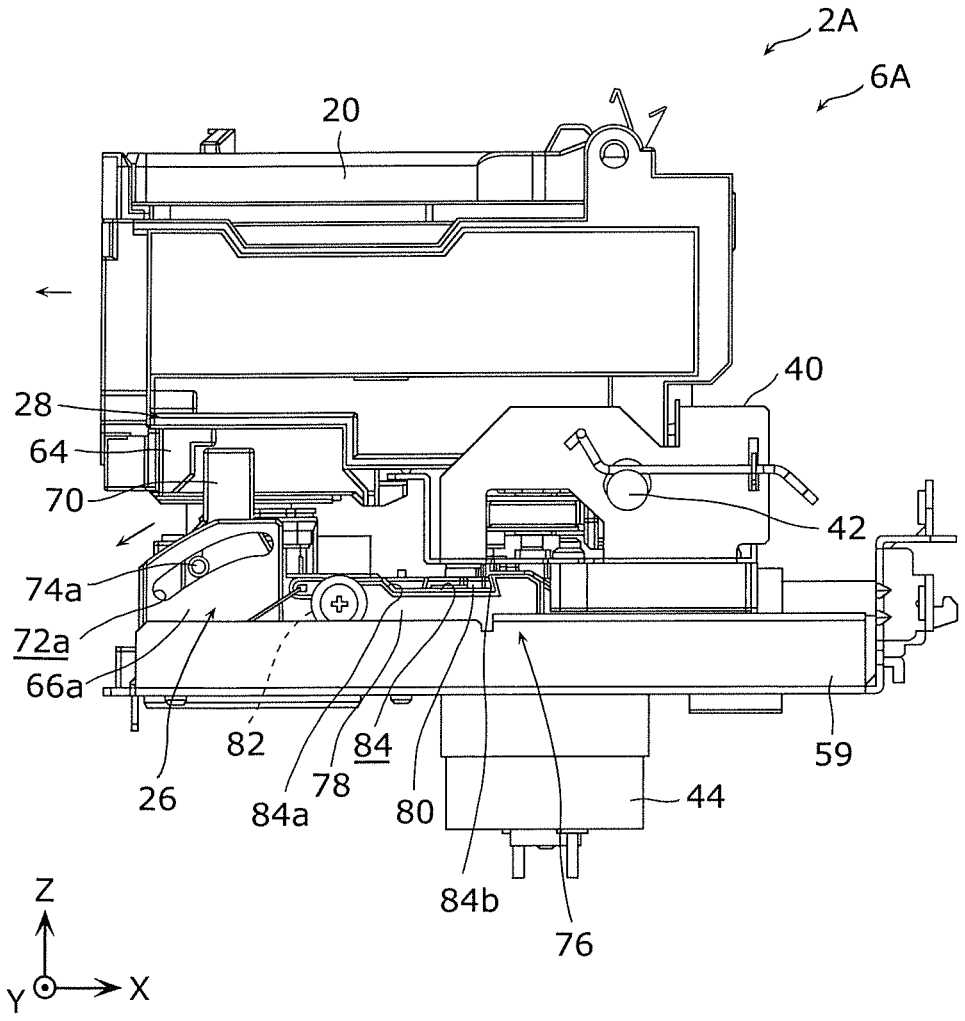
FIG. 13 is a side view illustrating the printing unit of the printer according to Embodiment 2 where the nozzle cap is in the third position.
Figure 14:
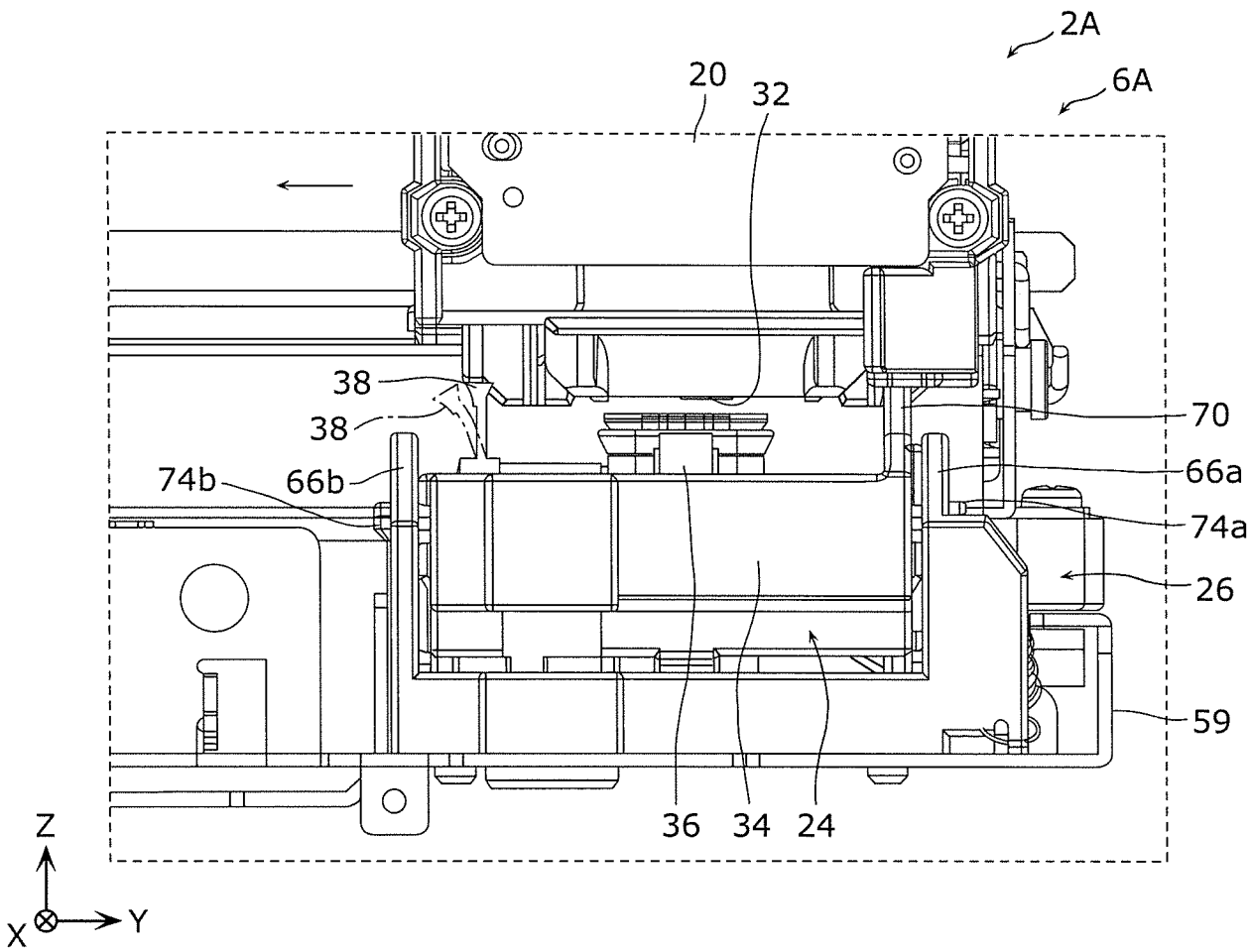
FIG. 14 is a partially enlarged diagram illustrating the printing unit of the printer according to Embodiment 2 where the nozzle cap is in the third position.

Next, the operation of holding mechanism 76 will be described with reference to FIGS. 10 to 14. FIG. 13 is a side view illustrating printing unit 6A of printer 2A according to Embodiment 2 in the state where nozzle cap 36 is in the third position. FIG. 14 is a partially enlarged diagram illustrating printing unit 6A of printer 2A according to Embodiment 2 in the state where nozzle cap 36 is in the third position.

As illustrated in FIG. 10, nozzle face 32 of head 20 (see FIG. 9 described above) is capped with nozzle cap 36 (see FIG. 9 described above) in the first position in the state where head 20 is in the standby position. At this time, nail member 80 is engaged with one end 84*a* of cut-off portion 84 of lever member 78.

For example, when head 20 moves from the other side to one side in the first direction (from the plus side to the minus side of the X-axis) in the first direction at the start of printing in the state where nozzle cap 36 is in the first position, nozzle cap 36 moves from the first position toward the third position by the urging force from urging member 68A, as illustrated in FIGS. 11, 13, and 14. At this time, lever member 78 swings, and nail member 80 engages with the other end 84*b* of cut-off portion 84 of lever member 78. As a result, nozzle cap 36 stops moving, and is held in the third position. At this time, first engaging part 64 is disengaged from second engaging part 70.

As illustrated in FIG. 14, head 20 reciprocally moves in the second direction with respect to nozzle cap 36 in the state where nozzle cap 36 is held in the third position. As a result, nozzle face 32 of head 20 is wiped by wiper 38. In other words, nozzle face 32 of head 20 is held in a position allowing wiping by wiper 38 in the state where nozzle cap 36 is held in the third position. During wiping, the tip of wiper 38 comes into contact with nozzle face 32 of head 20, so that wiper 38 elastically deforms and curves in the second direction.

After the wiping is completed, head 20 moves in the second direction, and returns to the position illustrated in FIG. 14. When head 20 further moves from the other side to one side of the first direction (from the plus side to the minus side of the X-axis) in the first direction in the state where nozzle cap 36 is held in the third position, movable table 40 comes into contact with the other end of lever member 78. As a result, lever member 78 swings to disengage from nail member 80. Thereby, as illustrated in FIG. 12, nozzle cap 36 moves from the third position to the second position by the urging force of urging member 68A.

In the state where nozzle cap 36 is in the second position, nozzle face 32 of head 20 is held in a position not allowing wiping by wiper 38. For this reason, the tip of wiper 38 is not in contact with nozzle face 32 of head 20 when head 20 reciprocally moves in the second direction with respect to nozzle cap 36 in the state where nozzle cap 36 is in the second position.

[2-3. Effects]

As described above, because holding mechanism 76 holds nozzle cap 36 in the third position, nozzle face 32 of head 20 can be held in a position allowing wiping by wiper 38.

[Modifications]

The printers according to Embodiments 1 and 2 of the present disclosure have been described above, but these embodiments should not be construed as limitations to the present disclosure. For example, the embodiments above may be combined.

Although printing is performed on nail 10 of finger 8 of the hand of the user by printer 2 (2A) in the embodiments above, printing may be performed on any other objects such as a golf ball.

INDUSTRIAL APPLICABILITY

The present disclosure can be used as a printer for performing manicure printing on fingernails of hands of a user.

REFERENCE SIGNS LIST

2, 2A printer
4 housing
4*a* top surface
4*b* front surface
6, 6A printing unit
8 finger

10 nail
12 power supply switch
14 opening
16 finger holder
17 mirror
17*a* mirror surface
18 press cover
19 camera unit
19*a* wiring substrate
19*b* image capturer
20 head
22 driving mechanism
22*a* X-axis driving mechanism
22*b* Y-axis driving mechanism
24 head maintaining mechanism
26 interlocking mechanism
28 lock mechanism
30 head holder
31 ink head
32 nozzle face
34 cap holder
36 nozzle cap
38 wiper
40 movable table
42 Y-axis guide shaft
44 Y-axis motor
46 timing belt
48 bearing member
50 X-axis guide shaft
52 X-axis motor
54 worm gear
56 worm wheel
58 drive conversion mechanism
59 support plate
60 pinion gear
62 rack gear
64 first engaging part
64*a* first wall
64*b* second wall
66*a*, 66*b* guide plate
68, 68A urging member
70 second engaging part
72*a*, 72*b* guide hole
74*a*, 74*b* protrusion
76 holding mechanism
78 lever member
80 nail member
82 rotary shaft
84 cut-off portion
84*a* one end
84*b* other end
86 support wall

The invention claimed is:

1. A printer for printing on an object, the printer comprising:

a head including a nozzle face which ejects ink toward the object;

a driving mechanism which moves the head in a first direction and a second direction approximately orthogonal to the first direction;

a nozzle cap movable between a first position where the nozzle face is capped and a second position where the nozzle face is uncapped; and a lock mechanism which regulates movement of the head in the first direction and the second direction in a state where the nozzle cap is in the first position, wherein the driving mechanism includes:

a driving source;

a worm gear rotatable by the driving source;

a worm wheel engaged with the worm gear; and a drive conversion mechanism which converts rotation of the worm wheel to movement of the head in the first direction, and the lock mechanism regulates the movement of the head in the first direction by utilizing a self-locking characteristic of the worm gear in the state where the nozzle cap is in the first position.

2. A printer for printing on an object, the printer comprising:

a head including a nozzle face which ejects ink toward the object;

a driving mechanism which moves the head in a first direction and a second direction approximately orthogonal to the first direction;

a nozzle cap movable between a first position where the nozzle face is capped and a second position where the nozzle face is uncapped;

a lock mechanism which regulates movement of the head in the first direction and the second direction in a state where the nozzle cap is in the first position; and an interlocking mechanism which moves the nozzle cap from the second position to the first position in conjunction with movement of the head from one side to an other side in the first direction, wherein the interlocking mechanism includes:

a first engaging part disposed in the head;

a cap holder which holds the nozzle cap; and a second engaging part which is disposed in the cap holder and is engageable with the first engaging part, the first engaging part engages with the second engaging part when the head moves from the one side to the other side in the first direction, causing the nozzle cap to move from the second position to the first position in conjunction with the movement of the head, and the lock mechanism regulates movement of the head in the second direction by utilizing engagement between the first engaging part and the second engaging part in the state where the nozzle cap is in the first position.

3. The printer according to claim 2, further comprising:

a holding mechanism which holds the nozzle cap in a third position between the first position and the second position; and a wiper held by the cap holder, wherein the head moves in the second direction with respect to the nozzle cap in the state where the nozzle cap is held in the third position, causing the wiper to wipe the nozzle face.

4. The printer according to claim 3, wherein the holding mechanism includes:

an urging member which urges the nozzle cap from the first position toward the second position;

a lever member rotatably held by the cap holder; and a nail member which is engageable with the lever member, when the head moves from the other side to the one side in the first direction in the state where the nozzle cap is in the first position, the nozzle cap moves from the first position toward the third position by an urging force from the urging member, the lever member swings to engage with the nail member, causing the nozzle cap to be held in the third position, and when the head further moves from the other side to the one side in the first direction in the state where the nozzle cap is held in the third position, the lever member swings to disengage from the nail member, allowing the urging force from the urging member to move the nozzle cap from the third position to the second position.

* * * * *